US005214922A

United States Patent [19]

Dopazo

[11] Patent Number: 5,214,922

[45] Date of Patent: Jun. 1, 1993

[54] MULTI-EXPANDER CRYOGENIC COOLER

[75] Inventor: John J. Dopazo, Buena Park, Calif.

[73] Assignee: Hughes Aircraft Company, Los Angeles, Calif.

[21] Appl. No.: 782,181

[22] Filed: Oct. 24, 1991

[51] Int. Cl.[5] ..... F25B 9/00

[52] U.S. Cl. ..... 62/6

[58] Field of Search ..... 62/6

[56] References Cited

U.S. PATENT DOCUMENTS 4,846,861 7/1989 Berry et al. ..... 62/6

4,894,996 1/1990 Kazumoto et al. ..... 62/6

5,010,737 4/1991 Okumura et al. ..... 62/6

*Primary Examiner*—John C. Fox

*Attorney, Agent, or Firm*—Terje Gudmestad; Georgann S. Grunebach; W. K. Denson-Low

[57] ABSTRACT

A cryogenic cooler 100 for cooling a plurality of detector arrays 106 having a single compressor 102 for reciprocating a cooling gas within the cryogenic cooler. A primary transfer line 108 is connected to the compressor for transferring the cooling gas. A reducing coupler 112 is connected to the primary transfer line for distributing the cooling gas between the primary transfer line and a plurality of equally sized secondary transfer lines 118. Each of the secondary transfer lines are connected to one of a plurality of modified expander elements 104. Each of the expander elements are in thermal communication with one of the plurality of detector arrays for cooling that one detector array as the gas is reciprocated within the cooler. In a specific implementation, the pressure wave of the cooling gas during the compression cycle causes the expander elements to cycle a displacer piston 130 to compress the gas at the cold end volume 144, thus allowing a screen mesh 142 in a regenerator 134 to absorb the heat caused by gas compression in a constant volume. During the expansion cycle, the regenerator 134 is cycled in the opposite direction expanding and cooling the gas at the cold. The regenerator screen mesh permits the heat of compression to be dissipated while storing the cooling effect at the cold tip 122 for cooling the detector array.

19 Claims, 2 Drawing Sheets

MULTI-EXPANDER CRYOGENIC COOLER

BACKGROUND OF THE INVENTION

1. Field of the Invention

The present invention relates to cryogenic coolers. More specifically, the present invention relates to methods and apparatus for Split-Stirling cryogenic coolers having multiple expander elements operating from a single compressor.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

In many applications, there is a need for a small, lightweight cooling system. Consider, for example, the fact that a single conventional infrared detector is typically packaged and positioned to permit reception of infrared radiation from a single field-of-view. In order to expand the view window, multiple infrared detectors must be utilized, for example, by placing one detector in each quadrant. However, each of the four detectors must be cooled to function properly. Generally, in order to cool four infrared detectors, four separate cryogenic cooler systems have typically been required, each having an associated compressor and expander.

The Stirling cycle engine consists of a compressor piston with a cylinder, an expansion piston with a cylinder, and a drive mechanism. The drive mechanism converted the rotary motion of a motor and crankshaft to a reciprocating motion of the two pistons ninety degrees out-of-phase. A regenerator and a crankcase housing were also included. Cooling is effected by the expansion cycle of a gas at the regenerator/expander assembly.

The basic Stirling cycle engine technology is employed in a Split-Stirling cooler with the exception that the reciprocating displacer piston and cylinder located within the expander are physically separated from the compressor and the regenerator is located within the displacer piston. The reciprocating displacer piston within the expander and the compressor are then interconnected with a small diameter gas transfer line which is sufficiently flexible to avoid the introduction of excessive spring torque to the system. This design permits the compressor, which is large compared to the expander, to be located remotely where available volume and heat rejection capability exists. The Split-Stirling cryogenic cooler is pneumatically driven so that gas pressure differentials on opposite sides of the displacer piston and cylinder provide the motive force to the cryogenic cooler.

While the Split-Stirling cycle engine is generally smaller and lighter than the Stirling cycle cooler, unfortunately, the use of conventional Split-Stirling cycle engines, provides a design which is too heavy, bulky and power hungry for many applications. Thus, a need remains in the art for a small, lightweight, low power cryogenic cooling system.

SUMMARY OF THE INVENTION

The need in the art is addressed by the gas driven Split-Stirling cryogenic cooler of the present invention.

The invention is a cryogenic cooler for use in cooling a plurality of detector arrays having a compressor for reciprocating a pressure wave of cooling gas within the cryogenic cooler. A first end of a primary transfer line is in mechanical communication with the compressor for transferring the reciprocated pressure wave of cooling gas. A gas reducing coupler is connected to a second end of the primary transfer line for distributing the reciprocated pressure wave of cooling gas between the primary transfer line and a plurality of equally sized secondary transfer lines. Each of the equally sized secondary transfer lines are connected to one of a plurality of modified expander elements. Likewise, each of the modified expander elements are in thermal communication with one of the plurality of detector arrays for cooling that one detector array as the pressure wave of cooling gas is reciprocated within the cryogenic cooler.

In a specific implementation, the pressure wave of the cooling gas during the compression cycle causes the modified expander element to cycle a displacer piston. The cycling of the displacer piston is effective to compress the cooling gas at the cold end volume. This allows a screen mesh in a regenerator to absorb the heat caused by compression of the cooling gas in a constant volume in accordance with Boyle's law. During the expansion cycle, the regenerator is cycled in the opposite direction expanding and cooling the gas at the cold end volume. The regenerator screen mesh permits the heat of compression to be dissipated while storing the cooling effect at the cold tip for cooling the detector array to which the modified expander element is in thermal communication.

Thus, the invention provides an arrangement for cooling multiple detector arrays by employing multiple expander elements operated from a single compressor.

DESCRIPTION OF THE INVENTION

Figure 1:
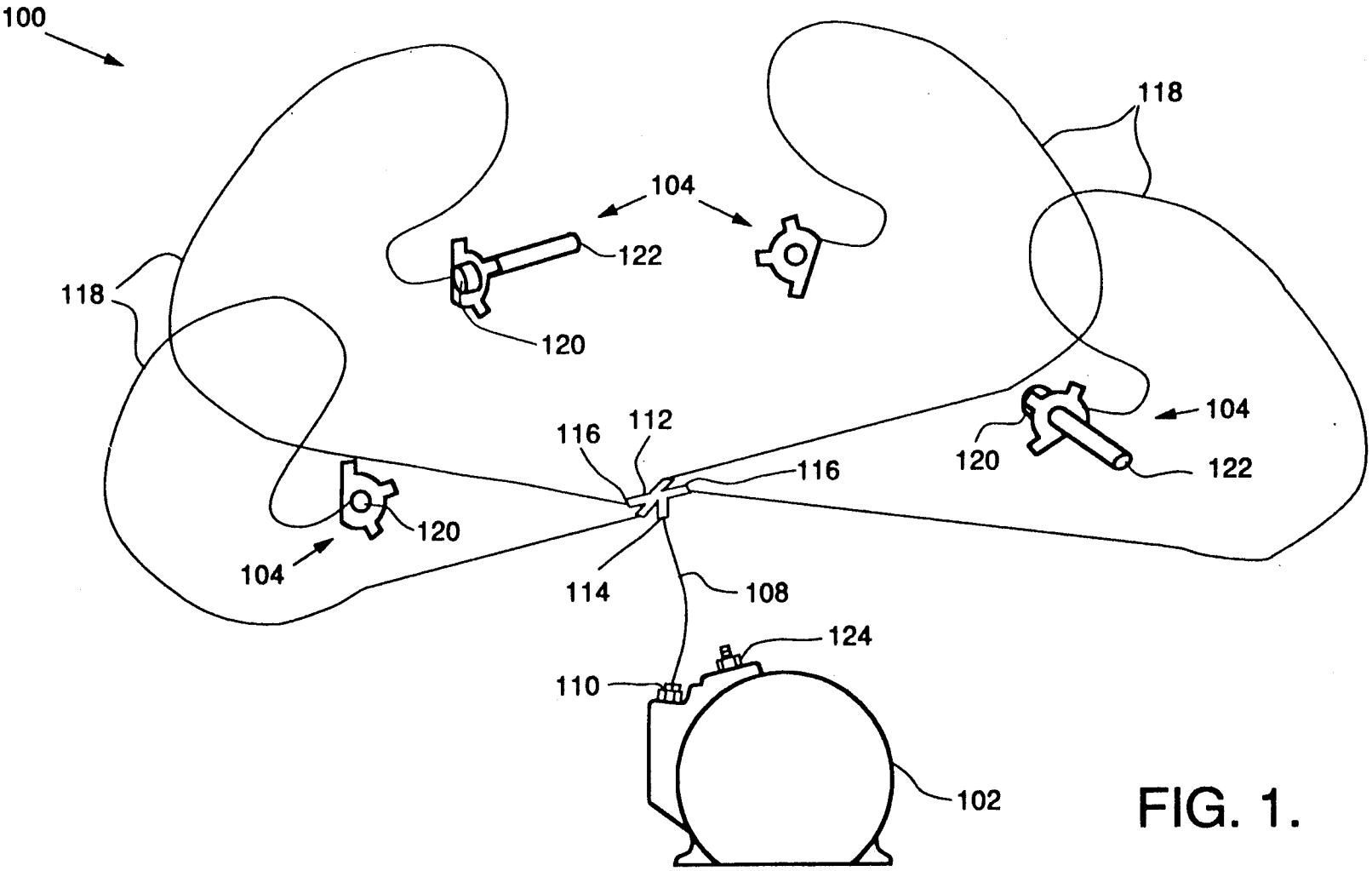
FIG. 1 is a perspective view of an illustrative embodiment of the multi-expander cryogenic cooler of the present invention arranged for use in a typical cooling system.

As shown in the drawings for purposes of illustration, the invention is embodied in a Split-Stirling cryogenic cooler of the type having a single compressor for transferring a cooling gas in a reciprocating fashion to a plurality of modified expander elements for simultaneously cooling an equivalent number of infrared detectors arrays.

A single infrared detector has a limited view. In order to expand the view window, multiple infrared detectors must be utilized. This invention provides a multi-focal plane thermal vision unit which permits reception of infrared radiation from multiple directions and requires multiple infrared detectors. The present invention permits each of the detectors to be cooled by a single cryogenic cooler having a single compressor and a plurality of modified expander elements for providing, for example, a four focal plane array as shown in FIGS. 1 -4. The disadvantages of excessive weight, volume and electrical power requirements associated with conventional multi-focal plane thermal vision units have been eliminated.

The Split-Stirling cryogenic cooler 100 of the present invention is shown in FIG. 1. The invention is embodied in a Split-Stirling cryogenic cooler 100 of the type having a single compressor 102 for transferring a cooling gas in a reciprocating fashion to a plurality of modified expander elements 104 for simultaneously cooling an equivalent number of infrared detectors arrays 106. The invention includes a primary gas transfer line 108 having one end connected to a gas input/output port 110 of the single compressor 102. The primary transfer line 108 extends from the compressor port 110 and is connected at the other end to a multi-port gas reducing coupler 112. The reducing coupler 112 can include, for example, a single feed port 114 and four equally sized distribution ports 116. At the free end of each of the equally sized distribution ports 116, there is connected one end of a secondary gas transfer line 118. The other end of each of the secondary transfer lines 118 is connected to a gas inlet 119 at a warm end 120 of one of the plurality of modified expander elements 104. Finally, a cold tip 122 of each of the modified expander elements 104 is positioned to thermally communicate with one of the plurality of detector arrays 106.

The single compressor 102 is a very simple device which requires no valves and is driven by a motor/crankshaft and piston mechanism (not shown). Various drive motors and mechanisms known in the art can be used depending upon the type of input electrical power available. A linear driven compressor can be utilized where appropriate. The single compressor 102 includes the input/output gas port 110 for transmitting and receiving gas pressure pulses during the compression and expansion cycles, respectively. The compressor 102 further includes a purge and fill port 124 for removing and inserting helium gas as shown in FIG. 1.

The output of the compressor 102 is a sinusoidally varying pneumatic pressure pulse which is transmitted to each of the plurality of modified expander elements 104 via the primary transfer line 10 and the corresponding secondary transfer line 118 associated with each expander element. The pneumatic pressure pulse is used to accomplish two different functions in the expander elements 104. Initially, the pressure pulse provides the driving force to cause a displacer piston 130 to reciprocate inside an expander housing 132 at the same cyclic rate as the compressor crankshaft and piston mechanism and with the desired ninety degree phase angle. Second, the compression and expansion of the helium gas in conjunction with a regenerator assembly 134 located within the displacer piston 130, produces the desired cryogenic refrigeration at the cold tip 122 of the expander elements. It is noted that the expander portion of the Split-Stirling cryogenic cooler 100 can have multiple stages of expansion to produce lower temperatures.

The primary transfer line 108 has a larger inner diameter than the inner diameter of the plurality of secondary transfer lines 118. Each of the secondary transfer lines 118 are matched with respect to inner diameter and length which is a significant design criteria for maintaining balance between the expander elements 104. In particular, this design criteria prevents any individual expander element from communicating or interfering with the operation of the other expander elements. If the inner diameters and lengths of the individual secondary transfer lines 118 were not matched, the individual expander elements 104 would exhibit different cooling capacities. This discrepancy would result in an imbalance in the cooling capacity of the entire cryogenic cooler 100.

Optimum inner diameters and lengths for the primary transfer line 108 and each of the plurality of secondary transfer lines 118 have been determined empirically. An example of these empirical results includes a primary transfer line 108 having an inner diameter of 0.040" and a length within the range of 4" to 20". Additionally, an example of the plurality of secondary transfer lines 118 include an inner diameter of 0.027" and a length within the range of 4" to 18". The performance of the cryogenic cooler 100 is not adversely affected by the lengths of the secondary transfer lines 118 if they are matched according to inner diameter and their respective lengths are equivalent and within the above-mentioned range. Although length ranges of from 4" to 20" have been found to result in acceptable system performance, shorter transfer line lengths provide improved cooling capacity. Longer transfer line lengths result in increased gas pressure drop.

Figure 3:
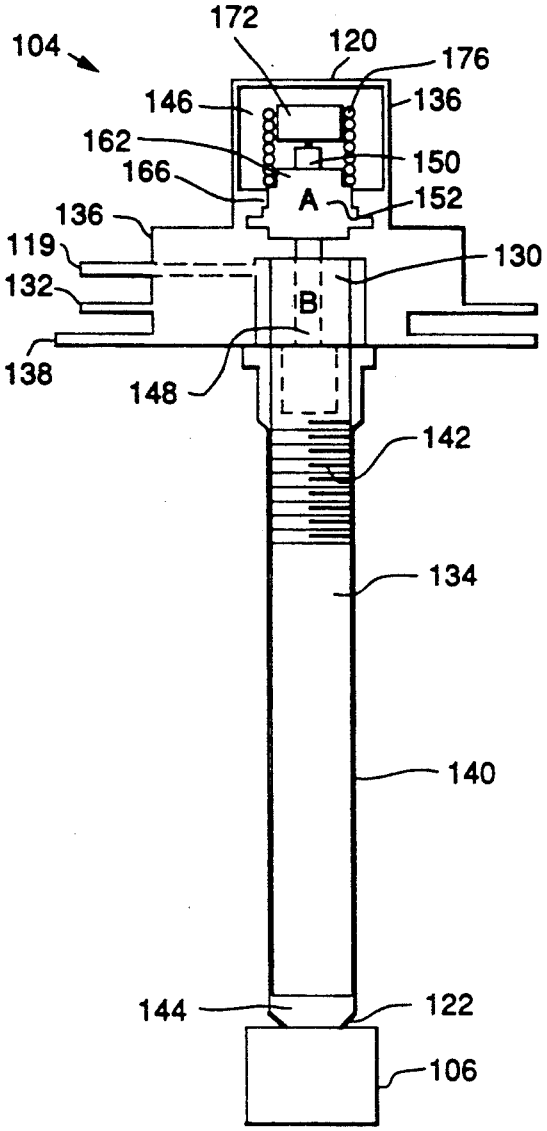
FIG. 3 is a simplified frontal elevational view, partly in cross-section, of the expander element of FIG. 2.
Figure 2:
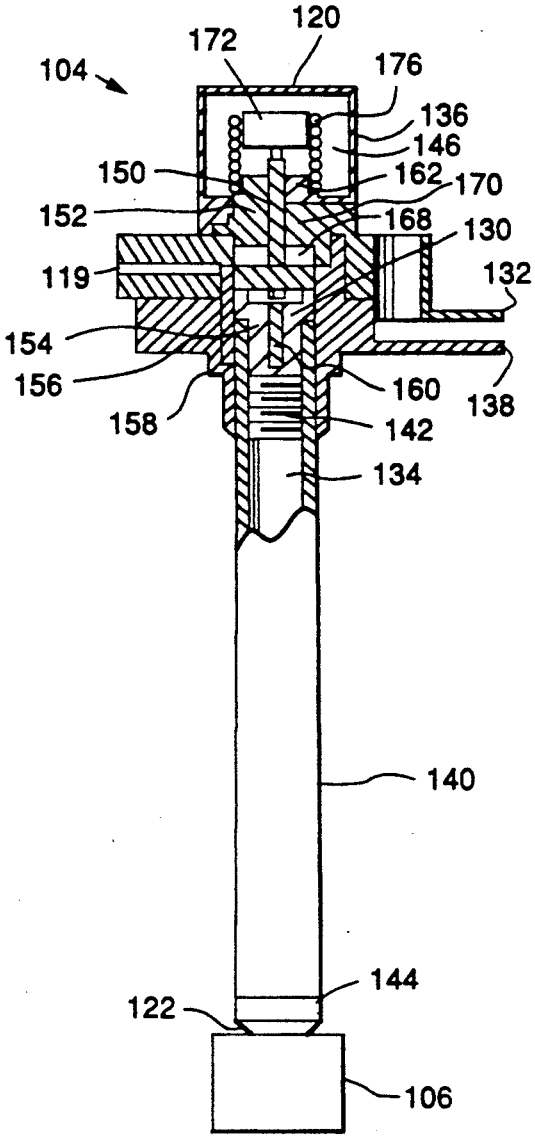
FIG. 2 is a frontal elevational view, partly in cross-section, of an expander element for use in the multi-expander cryogenic cooler of FIG. 1.

Each of the modified expander elements 104 is identical and can be constructed in accordance with the following description. In general, the cooling gas transmitted from the compressor 102 is directed to the gas inlet 119 of the warm end 120 of each of the expander elements 104. Mounted at the warm end of the expander element 104 is an end cap 136 which is a structural cover for enclosing each of the components mounted behind the expander housing 132. The end cap 136 may be bolted in place by a plurality of fasteners (not shown). The expander housing 132 functions to house those components between the end cap 136 and a cylindrical flange 138 as shown in FIGS. 2 and 3. The cylindrical flange 138 facilitates the mounting of the expander element 104 as well as heat dissipation. The expander housing 132 is securely attached to the cylindrical flange 138 as by brazing or may be formed as a unitary part.

Extending between the cylindrical flange 138 and the cold tip 122 is an outer pressure vessel 140 comprising a long thin-walled tubular structure. The pressure vessel 140, like the flange 138, can be constructed of a thermal conductor such as stainless steel. The function of the pressure vessel 140 is to house components of the expander element including the displacer piston 130, the regenerator assembly 134, a screen mesh 142 enclosed within the regenerator assembly 134, and a cold end expansion volume 144. The pressure vessel 140 may also be securely attached to the flange 138 typically by brazing. Penetrating the end cap 136 is the expander element gas input 119 which connects to the corresponding secondary gas transfer line 118 as shown in FIGS. 1-3. The gas inlet 119 provides a means for delivering the helium gas from the compressor 102 to a spring volume 146 and the regenerator assembly 134 and to various other volumes within the expander element 104.

The warm end 120 of the expander element 104 is located at the end cap 136 which encloses the spring volume 146, a volume in which the working pressure of the helium gas remains constant. The spring volume 146 functions to provide a motive force to the warm end (ambient side) 120 of the expander element 104. The gas pressure within the spring volume 146 does not fluctuate and is at approximately the mean pressure point of the oscillating pressure wave produced by the single compressor 102. The oscillating pressure wave is sinusoidal in nature so that the pressure about the displacer piston 130 varies sinusoidally.

Mounted within the outer pressure vessel 140 is the displacer piston 130 which is a cylindrical structure fashioned to fit within the outer pressure vessel. Positioned within the displacer piston 130 is the regenerator assembly 134 which includes the screen mesh 142. The screen mesh 142 dissipates heat from the cold tip 122 and can be, for example, formed in a porous matrix. The cooling gas freely flows through the porous matrix of the screen mesh 142 with the gas either absorbing latent heat from the regenerator assembly 134 or depositing latent heat into the high thermal enthalpy material comprising the screen mesh. Therefore, the gas is either pre-cooled or preheated depending upon the direction of the gas flow. The screens are flat torus (ring) shaped and are captured within the regenerator assembly 134. The screen mesh 142 is typically comprised of a fine mesh material such as, for example, stainless steel. In the assembly, the screens are stacked on top of each other so that layers are arranged perpendicular to the flow direction of the gas medium. The regenerator assembly 134 is aligned with a displacer piston hole 148 to direct the cooling gas from the gas inlet 119 penetrating the end cap 136 to the regenerator assembly via the displacer piston 130. Thus, the displacer piston hole 148 forces the gas medium to flow through, instead of around, the screen mesh 142 as shown in FIG. 3.

Generally, the gas medium is pumped in from the compressor 102 and enters the warm end 120 of the expander element 104 at the gas inlet 119. The gas medium is then directed to the regenerator assembly 134 from the gas inlet 119 and the displacer piston hole 148. The gas is pre-cooled by progressively cooler sections of the screen mesh 142 which are stacked in the regenerator assembly 134. Thus, when the gas exits the regenerator assembly and enters the expansion volume 144 at the cold end of the expander element 104 (e.g. cold tip 122 as shown in FIGS. 2 and 3), the gas is nearly at the expansion temperature. The cold tip 122 is the coldest part of the expander element 104 and is that portion that is in mechanical communication with the detector array 106. The cold tip 122 acts as a heat sink and cools the detector array 106 by virtue of the gas expansion within the expansion volume 144 located between the cold tip 122 and the displacer piston 130. The cold tip 122 is comprised of a metal having a high thermal conductivity and may be fashioned from, for example, pure nickel or copper.

The displacer piston 130 can be comprised of, for example, a thin-walled fiberglass shell which is positioned within the outer pressure vessel 140 to approximately ¼" from the cold tip 122. It is within this ¼" space that the cold end expansion volume 144 is located. The displacer piston hole 148 in combination with the displacer piston 130 functions to displace the cooling gas within the regenerator assembly 134 when driven by a small drive piston or pin 150 of a plunger assembly (drive pin housing) 152. The fiberglass shell of the displacer piston 130 acts as an insulating structural body which prevents heat flow from the warm end 120 to the cold tip 122 while displacing the gas medium from the expansion volume 144 to the pneumatic spring volume 146. It is this fiberglass shell that reciprocates within the outer pressure vessel 140 and which is sealed off at the end adjacent to the drive piston 150 by a displacer piston end cover 154. The end cover 154, which fits around the end of the displacer piston shell, assists in preventing leakage of the gas medium through the cylindrical flange 138.

The displacer piston 130 is an integral component of the expander element 104 mounted so as to reciprocate within the outer pressure vessel 140. The stroke of the displacer piston 130 is very short on the order of 0.001" and having a diameter of approximately ¼". In general, the gas medium is moved from the warm end to the cold end of the expander element 104 during a first stroking motion while the gas medium is moved from the cold end to the warm end during a second stroking motion. During the stroking motions, the gas medium is forced to flow through the displacer piston hole 148 and through the screen mesh 142 of the regenerator assembly 134.

Mounted immediately within the interior of the flange 138 is an annular ambient heat exchanger 156 which is employed for removing heat from the gas medium delivered at the gas inlet 119. The removed heat is then deposited in the flange 138, forming a portion of the housing structure. Just inboard of the ambient heat exchanger 156 and outboard of the end cover 154 is a displacer seal sleeve 158. The seal sleeve 158 and the end cover 154 function to seal the sliding displacer piston 130 so that the gas medium cannot flow through the space between the displacer piston 130 and the outer pressure vessel 140. The sleeve is a close-fitting clearance piece, such as an annular ring, which constitutes a seal between the displacer piston 130 and the displacer seal sleeve 158 to force the gas to flow through the displacer piston hole 148 and into the regenerator assembly 134 to the cold tip 122. Thus, the gas is forced to flow through the porous screen mesh 142 of the regenerator assembly 134.

Connected to the end cover 154 by a hinge pin 160 is the small drive piston 150. The hinge pin 160 is a small metal pin that passes through and retains the drive piston 150 to the displacer end cover 154 as is shown in FIG. 2. This hinge pin 160 provides a good, flexible alignment between the small drive piston 150 and the displacer piston 130. The small drive piston 150, also known as a drive pin or plunger, provides the area differential of the two displacer piston ends necessary to provide the motive force to the displacer piston 130. Thus, under the appropriate conditions, the displacer piston 130 and the drive piston 150 stroke from one end to the other.

This is accomplished by virtue of a pressure differential that exists across the drive piston 150 and the displacer piston 130. The drive piston 150 also maintains the displacer piston 130 in a centered position. The clearance space between the outer diameter of the drive piston 150 and the interior of the displacer piston end cover 154 is sealed by a drive piston sleeve 162. The drive piston sleeve 162 acts to guide the small drive piston 150 and to prevent substantial gas leakage into or out of the spring volume 146. The outer stepped surface of the plunger assembly 152 interfaces with the end cap 136 at the warm end 120 in a sealing surface 166 for sealing the spring volume 146 as shown in FIG. 3.

A displaced (swept) volume 168 exists between the drive piston sleeve 162 and the displacer end cover 154 at the warm end of the displacer piston 130. The swept volume 168 is a clearance which permits the displacer piston 130 to stroke to the warm end of the expander element 104, the displacer piston 130 being shown at the mid-position in FIG. 2. A sealed clearance 170 in the form of a small annular space is located between the small drive piston 150 and the drive piston sleeve 162. The sealed clearance 170 is utilized to force the gas medium to flow through the regenerator assembly 134.

Mounted at the end of the small drive piston 150 is a bumper 172. The bumper 172 is comprised of a steel core with a rubber like material affixed thereon. The bumper 172 functions to strike the drive piston sleeve 162 and to stop the displacer piston 130 from impacting the cold tip 122 when the small drive piston 150 strokes from the warm end 120 toward the cold tip. Such an impact would otherwise generate mechanical vibrations that would be transmitted to the detector array 106. When the small drive piston 150 strokes from the cold end to the warm end, the bumper 172 serves to cushion the drive piston 150 from impact with the inside of the end cap 136. Under steady state conditions, the forces within the expander elements 104 are balanced and reverse quickly enough so that the displacer piston 130 never strokes to the limits or impacts the bumper 172.

A centering spring 176 shown in FIGS. 2 and 3, serves to prevent the displacer piston 130 from drifting too close to either end of the stroke. However, during the cool down periods, while the working fluid (helium gas) is still warm, stroking of the displacer piston 130 is more severe and the bumper 172 is typically impacted by the displacer piston 130. The pressure wave produced by the compressor 102 is sinusoidal in nature so that the pressure in the various volumes of the expander elements 104 varies sinusoidally. However, the gas pressure within the spring volume 146 does not fluctuate and is at approximately the mean pressure point of the oscillating pressure wave.

In practice, a certain volume of gas medium leaks past the small drive piston 150 through the sealed clearance 170. As the pressure wave varies sinusoidally, a state of equilibrium is established in the spring volume 146. Such a condition is characterized by equal leakage in both directions of the sealed clearance 170 such that the pressure in the spring volume 146 equals the mean pressure of the oscillating pressure wave. This mean pressure is with respect to the pressure of the swept volume 168 and the expansion volume 144, each of which experience the cyclic pressure fluctuations. The centering spring 176 connected between the drive piston sleeve 162 and the bumper 172, although not essential, is utilized for aligning the displacer piston 130 at the midpoint of the stroke. Such a design is useful for preventing the displacer piston 130 from impacting the extreme ends of the stroke cycle. It is noted that the relative force generated by the spring volume 146 is much greater than the alignment force created by the centering spring 176.

During the compression cycle of the compressor 102, the pressure wave of the cooling gas causes the modified expander element 104 to cycle the displacer piston 130 to compress the gas at the cold end volume 144 thus allowing the screen mesh 142 in the regenerator assembly 134 to absorb the heat caused by compression of the cooling gas in a constant volume in accordance with Boyle's law. In general, Boyle's law of gases states that when a gas is compressed in a constant volume, the gas heats up and when a gas is expanded in a constant volume, the gas cools down. Therefore, during the expansion cycle, the regenerator assembly 134 is cycled in the opposite direction and expands the gas at the cold end volume 144 causing the gas to cool down. Thus, the regenerator screen mesh 142 permits the heat of compression to be dissipated as the gas is returned to the compressor 102 during the expansion cycle while storing the cooling effect at the cold tip 122.

In operation, the expander element 104 is pressurized with the sinusoidal pressure wave so that the pressure rises from some minimum to some maximum pressure. The expansion volume 144 is then pressurized and a predominating pressure force is established on the cold exterior end of the displacer piston 130. When the cyclic pressure is high, this cold end pressure force is applied towards the ambient end of the expander element 104. Simultaneously, a similar but opposing pressure force acts on the warm exterior end of the displacer piston 130. Since the area at the Warm end 120 is reduced by the equivalent frontal area of the drive piston 150, the pressure force at the warm end of the expander element 104 is correspondingly smaller. Since the pressure in the spring volume 146 is less than the pressure in the remainder of the expander element 104, the net force and direction act towards the warm end 120. The force balance equation for the displacer piston 130 is $$F=[(P1-P2)\times A1] \quad [1]$$

where P1 and P2 are the sinusoidally varied working pressure and the pressure of the spring volume 146, respectively and A1 is the area of the small drive piston 150. If P1 is greater than P2, then the force "F" is positive implying a net force towards the warm end 120. It can be seen that the forces reverse as the exterior pressure fluctuates during the cycle and that the inertia of the displacer piston 130 is the only opposition to the pressure forces.

Therefore, when the magnitude of the sinusoidal pressure wave is high, the displacer piston 130 strokes from the cold tip 122 to the warm end 120. The displacer piston 130 continues to stroke from the cold tip 122 to the warm end 120 until the bumper 172 impacts end cap 136, or until the sinusoidal pressure wave has dropped sufficiently to reverse the force balance as the compressor 102 begins to withdraw gas from the expander element 104 (e.g., during the expansion stroke). Thus, the gas medium is initially pumped into and then withdrawn from the expanded element 104. The varying gas pressure within the expansion volume 144 begins to drop and when the varying pressure drops below the mean point constant pressure of the spring volume 146, the forces reverse. While the pressure force summation may have reversed direction, the kinetic energy may still cause the expander element 104 to continue to move in opposition to that force briefly during the cycle. During steady state under cooled-down operation, the forces and the stroke are so designed as to permit the expander element 104 to stroke nearly to the limits, but not enough to impact the bumper 172 at either end of travel.

Thus, when the magnitude of the sinusoidal pressure wave is low (e.g., gas pressure in the spring volume 146 exceeds the mean value of the oscillating pressure wave), the reciprocating drive piston 150 causes the displacer piston 130 to cycle from the warm end 120 to the cold tip 122 of the expander element 104 (e.g., during the compression cycle). Then, the entire cycle repeats with the net effect being that the displacer piston 130 cycles from the cold tip 122 to the warm end 120 when the pressure in the expander element is high and from the warm end to the cold tip when the pressure in the expander element is low. Thus, in both the compression and expansion cycles of the compressor 102, the helium gas is passing through the screen mesh 142 of the regenerator assembly 134 in either the forward or reverse direction. This constitutes net work performed by the gas in the expansion volume 144 on the displacer piston 130 for providing an equivalent refrigeration rating. By performing work on the displacer piston 130, the gas transmits energy to the displacer piston and a portion of this energy, in turn, is simultaneously deposited back into the gas at the opposite (warm) end of the displacer piston 130. This work expenditure simultaneously lowers the temperature of the cold tip 122 for cooling the detector array 106.

A significant advantage of the Split-Stirling cryogenic cooler 100 of the present invention is that each of the plurality of expander elements 104 is operated by the single compressor 102. In the past, a separate compressor was required to operate each expander element and upon attempting to operate multiple expander elements with one compressor, the cooling capacity was greatly reduced with each added expander element. In order to compensate for the reduced cooling capacity associated with multiple expander elements, the stroke of each of the displacer pistons 130 has been modified as is shown in FIGS. 3 and 4.

FIG. 3 is a simplified frontal elevational view of the more detailed diagram of FIG. 2. The entire plunger assembly or drive piston housing 152 including the small drive piston 150 is designated as element "A" while the displacer piston 130 is designated as element "B". Each of the elements "A" and "B" are shown in FIG. 4 in their relative positions. The height dimension of the plunger assembly 152 as known in the past is approximately 0.243" which is indicated by the numerical designation 178 as shown in FIG. 4. In the present invention, the plunger assembly 152 (e.g., element "A") has been machined or shaved by approximately 0.043" to reduce the height dimension to approximately 0.200" which is indicated by the numerical designation 182 also shown in FIG. 4. As is clearly indicated, the plunger assembly 152 (e.g., element "A") has been machined or shaved on both the top and bottom surfaces thereof. The top surface of the plunger assembly 152 has been shaved by approximately 0.023" while the bottom surface has been shaved by approximately 0.017". A tolerance of approximately 0.0015" is applied to both the top and bottom surfaces.

The improvement of reducing the height of the plunger assembly 152 effectively provides additional space within the expander element 104 for increasing the stroke and the cooling capacity of the displacer piston 130. However, such an improvement to the plunger assembly 152 (e.g., element "A") results in a blockage of the gas medium from the secondary transfer lines 118 into the gas inlet 119 of the expander elements. This blockage of the gas medium results in degraded performance of the modified expander element 104. In the past, the top of the displacer piston 130 was square as indicated by the numerical designation 186 in FIG. 4.

Figure 4:
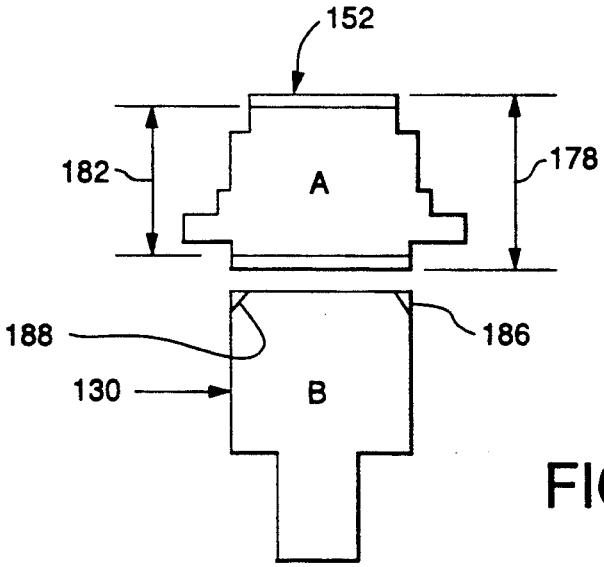
FIG. 4 is a frontal elevational view of the drive pin housing and the displacer piston as modified for increasing the stroke and capacity of each expander in the multi-expander cryogenic cooler of FIG. 1.

In the present invention, the top of the displacer piston 130 (e.g., element "B") has been chamfered by machining the corners in an angled fashion as indicated by the numerical designation 188 shown in FIG. 4. In the absence of a chamfer angle, the displacer piston 130 (e.g., element "B") would stick in position due to a vacuum effect caused by the shaved plunger assembly 152 (e.g., element "A"). Under these conditions, the flow of the gas medium would be impeded. Therefore, the significance of the chamfer angle is that sufficient space for the passage of the gas medium is provided. By way of example, the chamfer angle is approximately forty-five degrees.

Various materials can be employed to construct the multi-expander cryogenic cooler 100 of the present invention. For example, the primary transfer line 108, the equally-sized secondary transfer lines 118 and the reducing coupler 112 are each fashioned from stainless steel tubing. Most of the external components of the modified expander elements 104 are comprised of stainless steel including, but not limited to, the plunger assembly 152, the gas inlet 119, the outer pressure vessel 140, and the cold tip 122. The end cap 136 is formed from "15-5" stainless steel while the displacer piston 130 is fashioned from Ferrotec which includes a steel base combined with carbon fibers for strength.

Such an improvement permits free passage of the gas medium from the secondary transfer lines 118 into the gas inlet 119 of the respective expander elements 104 providing improved operation thereof. Further, the improvements to the plunger assembly 152 and displacer piston 130 have resulted in doubling the baseline capacity of each expander element 104 from one watt capacity at 80 Kelvin to two watts capacity at 80 Kelvin. Therefore, each expander element now generates more cooling capacity than like expander elements of the past so that the loss in the cooling capacity associated with employing multiple expander elements has been overcome.

Those skilled in the art will appreciate that the cryogenic cooler 100 of the present invention exhibits a weight, an initial cost and subsequent electrical power operating costs substantially lower than that of prior multiple expander cooler systems requiring multiple compressors. It is noted that the invention is applicable to a different number and type of expander elements than that shown in the exemplary drawing figures. Further, it has been shown that the multiple expander system can be maintained in balance by matching the length and inside diameters of the secondary transfer lines 118. This feature prevents communication between the expander elements 104. Further, the reduction in cooling capacity resulting from the use of multiple expander elements is overcome by increasing the cooling capacity of each expander element.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such modifications, applications and embodiments within the scope of the present invention.

Accordingly, what is claimed is:

1. A cryogenic cooler for use in cooling a plurality of detector arrays comprising:

means for reciprocating a cooling gas within said cryogenic cooler;

primary conduit means in mechanical communication with said reciprocating means for transferring said cooling gas;

means for distributing said cooling gas between said primary conduit means and secondary conduit means, said distributing means being in mechanical communication with said primary conduit means, and said secondary conduit means comprising a plurality of secondary gas transfer lines, each of said secondary gas transfer lines being equally sized and having equivalent lengths and inside diameters; and a plurality of expander elements for cooling said plurality of detector arrays, each of said plurality of expander elements being connected to one of said secondary gas transfer lines and in thermal communication with one of said plurality of detector arrays for cooling said one detector array as said cooling gas is reciprocated within said cryogenic cooler.

2. The cryogenic cooler of claim 1 wherein said reciprocating means is a compressor.

3. The cryogenic cooler of claim 1 wherein said plurality of detector arrays includes an infrared detector array.

4. The cryogenic cooler of claim 1 wherein said cooling gas is helium.

5. The cryogenic cooler of claim 1 wherein said primary conduit means is a primary gas transfer line.

6. The cryogenic cooler of claim 1 wherein said distributing means comprises a gas reducing coupler.

7. The cryogenic cooler of claim 1 wherein each of said plurality of expander elements further includes a plunger assembly and a displacer piston wherein said plunger assembly and said displacer piston are arranged to extend the stroke of said displacer piston for increasing the cooling capacity of each of said expander elements.

8. The cryogenic cooler of claim 1 wherein said plurality of expander elements each comprise a plunger assembly for operating a displacer piston in a reciprocating manner.

9. The cryogenic cooler of claim 8 wherein said plurality of expander elements each comprise a regenerator positioned within said displacer piston for removing heat from a terminal end of each of said expander elements, said terminal end being in thermal communication with said one detector array.

10. The cryogenic cooler of claim 9 wherein said regenerator further includes a porous matrix of screen mesh, wherein heat is transferred between said porous matrix of screen mesh and said cooling gas reciprocated within said cryogenic cooler.

11. A cryogenic cooler for use in cooling a plurality of detector arrays comprising:

a compressor for reciprocating a cooling gas within said cryogenic cooler;

a primary transfer line in mechanical communication with said compressor for transferring said cooling gas;

a reducing coupler in mechanical communication with said primary transfer line for distributing said cooling gas between said primary transfer line and a plurality of equally sized secondary transfer lines; and a plurality of expander elements for cooling said plurality of detector arrays, each of said plurality of expander elements being connected to one of said equally sized secondary transfer lines and in thermal communication with one of said plurality of detector arrays for cooling said one detector array as said cooling gas is reciprocated within said cryogenic cooler.

12. The cryogenic cooler of claim 11 wherein said plurality of detector arrays includes infrared detector arrays.

13. The cryogenic cooler of claim 11 wherein said cooling gas is helium.

14. The cryogenic cooler of claim 11 wherein said plurality of expander elements each comprise a plunger assembly for operating a displacer piston in a reciprocating manner.

15. The cryogenic cooler of claim 14 wherein said plurality of expander elements each comprise a regenerator positioned within said displacer piston for removing heat from a terminal end of each of said expander elements, said terminal end being in thermal communication with said one detector array.

16. The cryogenic cooler of claim 15 wherein said regenerator further includes a porous matrix of screen mesh, wherein heat is transferred between said porous matrix of screen mesh and said cooling gas reciprocated within said cryogenic cooler.

17. The cryogenic cooler of claim 11 wherein each of said plurality of expander elements further includes a plunger assembly and a displacer piston wherein said plunger assembly and said displacer piston are arranged to extend the stroke of said displacer piston for increasing the cooling capacity of each of said expander elements.

18. A method for cooling a plurality of detector arrays employing a single cryogenic cooler, said method comprising the steps of:

reciprocating a cooling gas within said cryogenic cooler with a single compressor;

transferring said cooling gas within said single cryogenic cooler through a primary transfer line in communication with said single compressor;

distributing said cooling gas between said primary transfer line and a plurality of equally sized secondary transfer lines through a reducing coupler; and cooling said plurality of detector arrays with a plurality of expander elements, each of said plurality of expander elements being connected to one of said plurality of equally sized secondary transfer lines and in thermal communication with one of said plurality of detector arrays for cooling said one detector array as said cooling gas is reciprocated within said single cryogenic cooler.

19. The method for cooling a plurality of detector arrays of claim 10 further including the step of arranging a plunger assembly and a displacer piston within each of said plurality of expander elements to extend the stroke of said displacer piston for increasing the cooling capacity of each of said expander elements.

* * * * *